US005231944A

United States Patent [19]

Jans et al.

[11] Patent Number: 5,231,944

[45] Date of Patent: Aug. 3, 1993

[54] ICEBREAKING SHIP

[75] Inventors: Peter Jans, Emden; Karl-Heinz Rupp; Jens-Holger Hellmann, both of Hamburg, all of Fed. Rep. of Germany

[73] Assignee: Thyssen Nordseewerke GmbH, Emden, Fed. Rep. of Germany

[21] Appl. No.: 820,423

[22] Filed: Jan. 14, 1992

[30] Foreign Application Priority Data

Jan. 16, 1991 [DE] Fed. Rep. of Germany ..... 4101034

[51] Int. Cl.[5] ..... B63B 35/08

[52] U.S. Cl. ..... 114/40

[58] Field of Search ..... 114/40–42, 114/56

[56] References Cited

U.S. PATENT DOCUMENTS

| | | | |
|---|---|---|---|
| 4,326,476 | 4/1982 | Pole | 114/40 |
| 4,506,617 | 3/1985 | Waas et al. | 114/41 |
| 4,831,951 | 5/1989 | Liljeström et al. | 114/41 |

FOREIGN PATENT DOCUMENTS

| | | | |
|---|---|---|---|
| 281653 | 9/1988 | European Pat. Off. | 114/40 |
| 0328720 | 8/1989 | European Pat. Off. . | |
| 2112333 | 9/1972 | Fed. Rep. of Germany . | |
| 2246173 | 3/1973 | Fed. Rep. of Germany . | |
| 2212147 | 9/1973 | Fed. Rep. of Germany . | |
| 2241840 | 3/1974 | Fed. Rep. of Germany . | |
| 2343719 | 3/1975 | Fed. Rep. of Germany . | |

*Primary Examiner*—Jesûs D. Sotelo

*Attorney, Agent, or Firm*—Nils H. Ljungman & Associates

[57] ABSTRACT

An icebreaking ship is equipped, on the forward quarter of the hull, on both side flanks in the vicinity of the water line, with first and second icebreaking structures, with the second icebreaking structure located at some distance behind the first. Between the two icebreaking structures is a recessed area, which has a curve profile which approximately matches the radius of curvature of the inside turning circle of the ship at the crown or zenithal line of the turning circle. The second icebreaking structure is designed so that it does not exceed the width of the hull and the recessed hull wall area between the icebreaking structures is designed as a waist-line-like indentation in the hull.

18 Claims, 5 Drawing Sheets

ICEBREAKING SHIP

BACKGROUND OF THE INVENTION

1. Field of the Invention

This invention relates to icebreaking ships for opening channels through ice fields so that merchant ships can pass relatively unhindered through the ice fields. These icebreaking ships often need to turn around within a limited space, and therefore, the hulls of the ships need to be designed to allow for narrow radius turns as well as for efficient breaking and clearing of the ice to form substantially ice-free channels to allow for passage of the merchant ships. Such a hull can be designed with two sets of icebreaking portions disposed at both sides of the forward portion of the hull, in the vicinity of the waterline. The width of the hull at the two ice-breaking portions should preferably not exceed the width of the ship. In addition, between the two icebreaking portions, on each side of the hull, there is preferably a recessed area which has a profile that substantially matches the radius of curvature of the inside turning circle of the ship at the zenithal line of the turning circle.

2. Background Information

It is known that, in order to provide the most ice-free channel for passage of merchant ships through ice fields, the hull of an icebreaking ship should be designed to not only break up the ice, but to also push the ice out of the channel, for example, by pushing the ice outwardly below the ice boundaries of the channel. The broken ice therefore does not fill the opened channel, and therefore essentially does not interfere with the propellers of any ships passing through the opened channel.

Known icebreaking ships, for example, those disclosed in U.S. Pat. No. 4,831,951, have both the first and the second icebreaking portions project laterally beyond the width of the hull itself. Accordingly, these icebreaking portions form beak-like, or bay window-like projections attached to the ship's skin. The second icebreaking portion of the ship disclosed in U.S. Pat. No. 4,831,951, is located above the water line, while the recessed areas between the icebreaking portions are approximately equal to the width of the ship. This design, of course, allows the icebreaker to turn with a relatively small radius of turning circle, but the optimum ratio between the width of the ice-free channel that is broken by the ship and the width of the ship itself, is not achieved. This optimum ratio is not achieved because, as mentioned above, the outer limits of the icebreaking parts, which outer limits naturally determine the width of the ice-free channel being made, project beyond the width of the ship. In many cases, however, it is desirable in terms of the weight, propulsion force and stability of the ship for the hull to have the greatest possible width in relation to the width of the ice-free channel that the hull is forming, i.e. the width of the ship and the width of the ice-free channel should be as equal as possible.

Another known icebreaking ship is disclosed in German Laid Open Patent No. 2246173. This German Patent shows only a first icebreaking portion which has a lateral limitation that is flush with the external contour of the hull. There is also a waistline-like indentation into the hull behind the ice-breaking portion. However, this indentation is not an indentation between two separate icebreaking portions located one behind the other, but is an indentation behind a single icebreaking portion. This indentation is not intended to take advantage of the maximum width of the ship, but is used only for the most ice-free possible exhaust of compressed air from a duct system that is a part of a ramming or tamping system.

OBJECTS OF THE INVENTION

The objects of the invention are to meet the requirements for good icebreaking characteristics and good turning capability, as indicated above, and accordingly to design an icebreaking ship in such a way that, while maintaining good icebreaking characteristics and good turning capability, the width of the ship is essentially the same as the width of the ice-free channel broken by the ship itself.

SUMMARY OF THE INVENTION

These objects are achieved by the icebreaking ship of the present invention, in which the icebreaking ship has, on both sides of the ship, a first, forward icebreaking portion preferably followed by a second icebreaking portion located a distance behind the first, with the two ice-breaking portions being separated by a waistline-like indentation. The waistline-like indentation is preferably designed so that the profile of the indentation essentially matches the inner radius of curvature of the turning radius of the ship. This makes it possible for the second icebreaking portion to be configured so that it does not project beyond the width of the ship, but is instead, substantially flush with the width of the ship. Accordingly, the width of the ship can now preferably be approximately the same as the width of the ice-free channel that is broken by the icebreaking portions of the hull of the ship.

Moreover, since the second icebreaking portions essentially no longer need to be configured as bay window-like projections located on the ship's skin, but are essentially corners of indentations recessed inside the ship, the depth of the indentations can essentially be selected to be as large as possible to allow the turning radius of the ship to be kept as small as possible. Essentially, the only limiting factors which limit the depth to which the indentations can be made are the structural factors of the hull at the point of the hull in question.

An advantageous embodiment of the invention is that the second icebreaking portion is located in the vicinity of the water line. Previously, pump systems were generally required to allow for any alternating heeling or listing of the ship when the icebreaking means were located somewhat above the water line. The location of the second icebreaking means in the vicinity of the water line, in accordance with the present invention, however, allows for a simplified recrushing of the ice by the second icebreaking portion when the ship turns. Thus, the pump systems that were previously needed can now be eliminated.

In order to enable the stern portion of the icebreaking ship of the present invention to turn out on the side away from the direction of rotation of the icebreaking ship, that is, when the ship is turning or when breaking out of the ice-free channel being broken into the solid ice, the back end or stern of the ship usually needs a certain clearance in the ice-free channel. This clearance can preferably be accomplished by tapering the stern side walls. In addition, the side walls are also preferably configured to have a balcony-like configuration to facilitate the turning out of the stern section into the solid ice, since the edges of this balcony-like projection provide an additional icebreaking effect on the side away from the direction of rotation of the ship.

It is also advantageous to provide, on the bottom of the ship, sweeper projections for guiding or forcing the broken ice out of the channel being cleared, and it is especially advantageous to provide two sets of sweeper projections to independently remove the ice broken by the first and second icebreaking portions of the ship. This independent sweeping of the ice keeps the ice broken by the second icebreaking portion from getting into the propeller, or back into the ice-free channel being broken into the ice.

One aspect of the invention resides broadly in a ship for breaking ice to clear a channel through an ice field in a direction of movement of the ship. The ship has a hull, and the hull has a maximum width, a bow section, and a stern section behind the bow section. The hull comprises: a first portion for breaking ice, the first icebreaking portion being disposed at the bow section of the hull; a second portion for breaking ice, the second icebreaking portion being disposed substantially behind the first icebreaking portion toward the stern section of the ship; and a recessed portion disposed between the first and the second icebreaking portions. The ship has a first width at the second icebreaking portion and the width of the ship at the second icebreaking portion is at most substantially equal to the maximum width of the hull.

An additional aspect of the invention resides broadly in a hull for an icebreaking ship for breaking ice to clear a channel through an ice field in a direction of movement of the ship. The hull has a maximum width, a bow section, and a stern section disposed behind the bow section. The hull comprises: a first portion for breaking ice, the first icebreaking portion being disposed at the bow section of the ship; a second portion for breaking ice, the second icebreaking portion being disposed substantially behind the first icebreaking portion towards the stern section of the ship; and a recessed portion disposed between the first and the second icebreaking portions. The hull has a first width at the first icebreaking portion, a second width at the second icebreaking portion, and a third width at the recessed portion. The third width at the recessed portion is less than the first width and the second width to define a waistline-like indentation between the first and the second icebreaking portions.

BRIEF DESCRIPTION OF THE DRAWINGS

Variants of the object of the invention are illustrated, in the form of schematic diagrams, by the accompanying drawings, in which.

DESCRIPTION OF THE PREFERRED EMBODIMENTS

In all of the figures, the same parts are identified by the same reference numbers.

Figure 2:
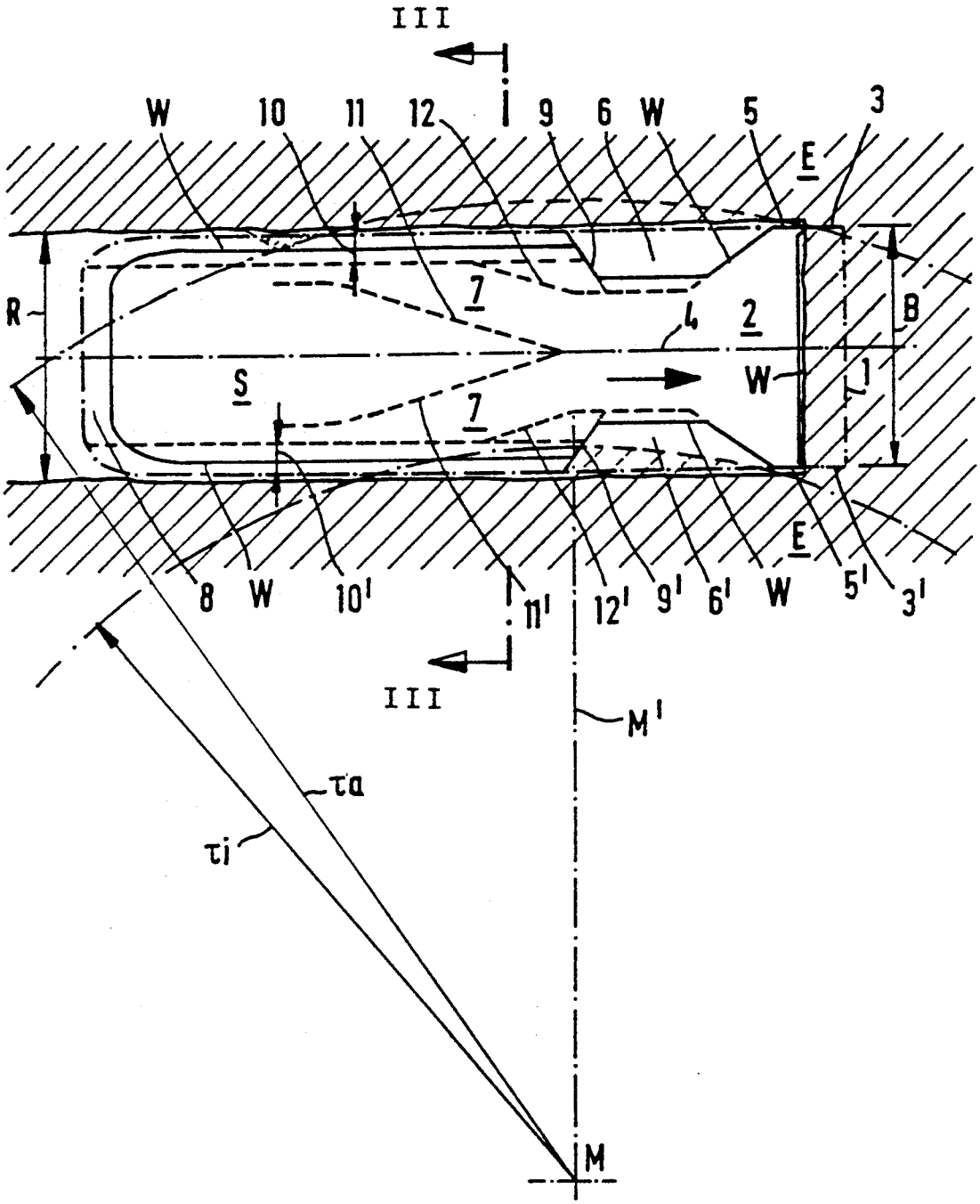
FIG. 2 shows a plan view of the hull of the ship illustrated in FIG. 1.
Figure 4:
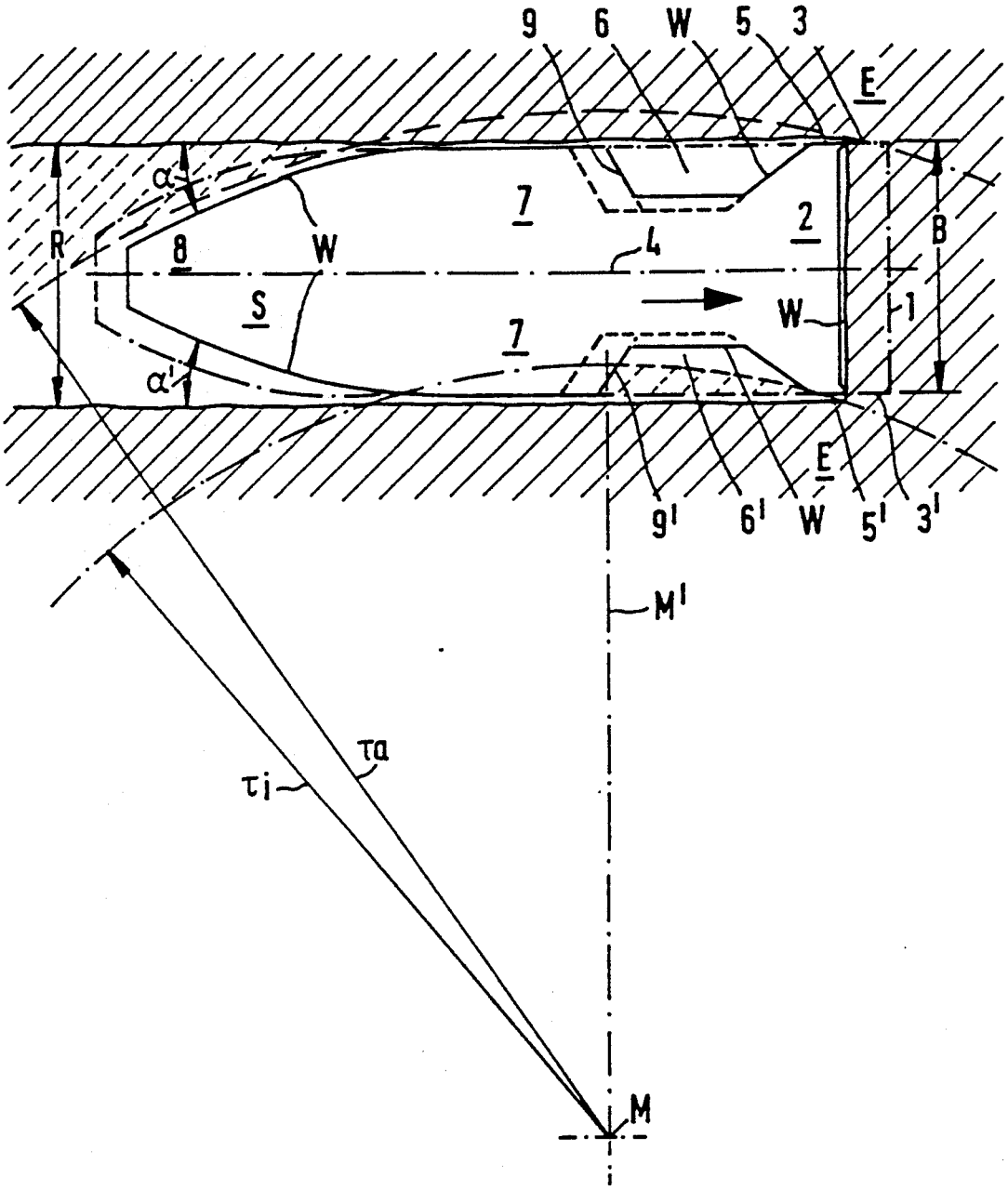
FIG. 4 shows a variant of a ship having a tapered stern section according to the present invention.
Figure 5:
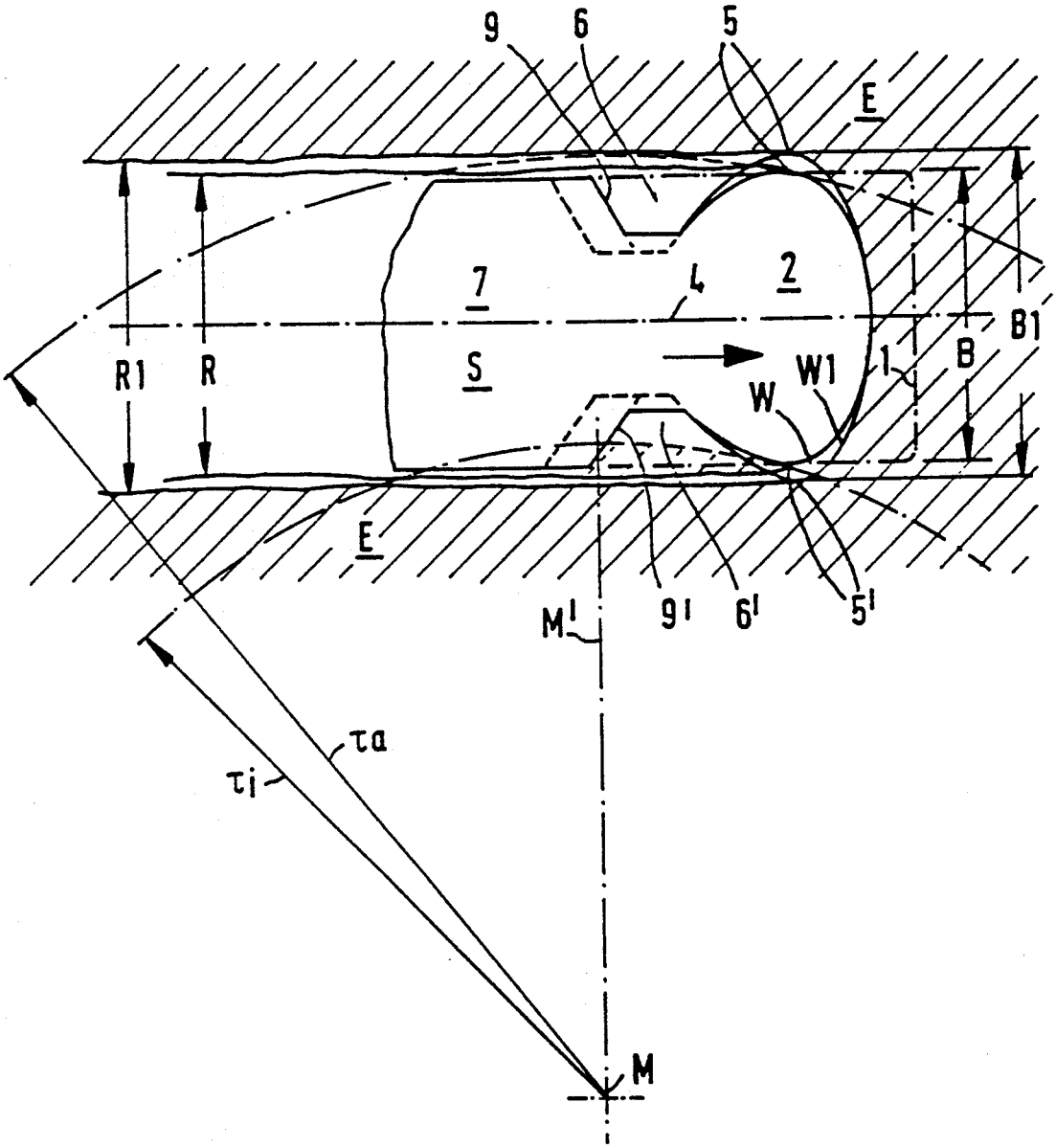
FIG. 5 shows a variant of the forebody of an icebreaking ship.

In FIGS. 2, 4 and 5, an icebreaking vessel, designated S, is shown in an ice-free channel R of an ice field E, which ice field E is being broken by the vessel itself. The ice field E is indicated by cross-hatching.

Figure 1:
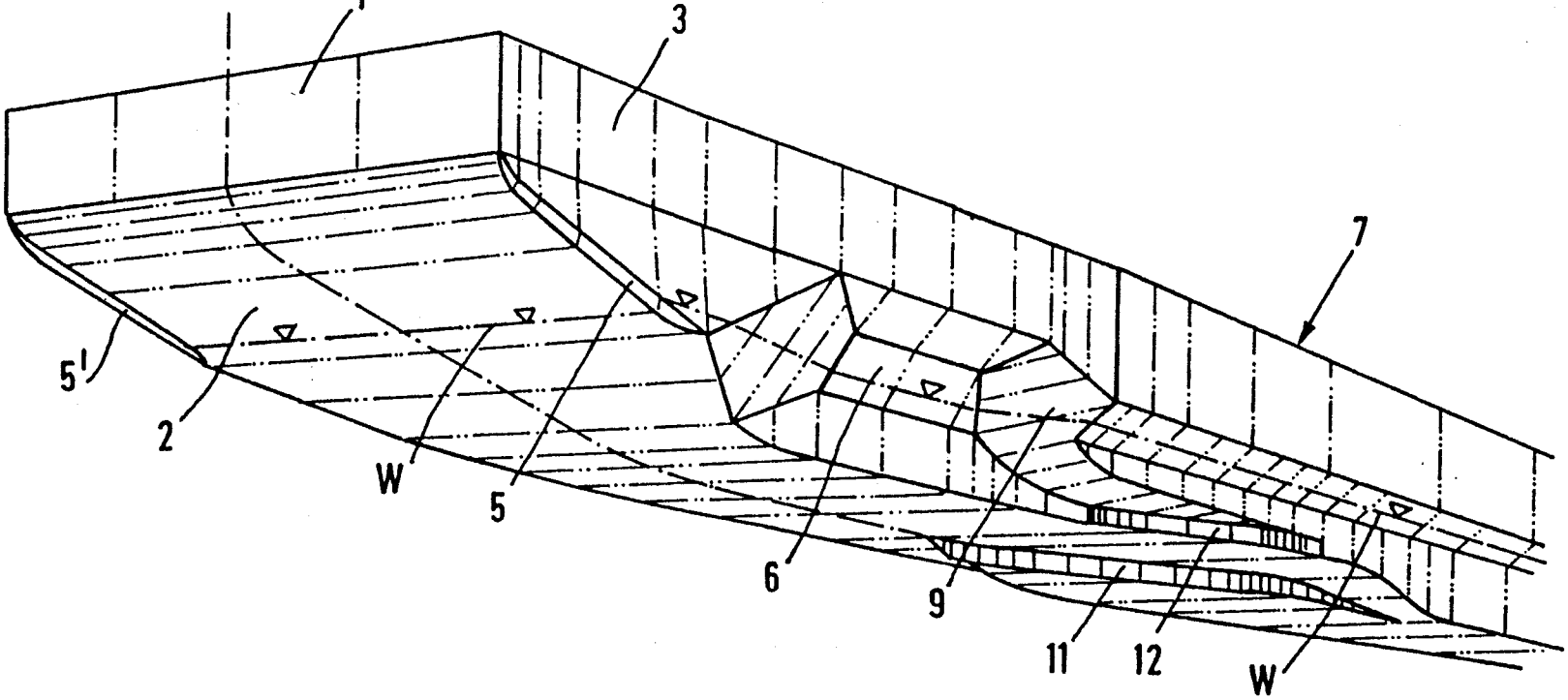
FIG. 1 shows, in a diagonal projection, a partial view, of a hull of a ship according to the present invention.

As shown in the Figures, the bow of the ship S is essentially formed by a bow plate 1. This bow plate 1 essentially forms the forward end of a pontoon-like forebody 2 which preferably rises diagonally forward from the base or low point of the hull. The side flanks 3, 3' of the forebody 2 in FIGS. 1 and 2, are essentially disposed vertically, or perpendicular to the underside of the ship, and are preferably parallel to the longitudinal axis 4 of the ship.

As shown in FIG. 5, the side flanks 3, 3' of the forebody 2 can preferably be inclined and rounded. On the side flanks 3, 3' of the pontoon-like forebody 2, there are preferably first icebreaking means 5, 5' in the vicinity of the water line W. In the embodiments illustrated, these first icebreaking means 5, 5' are preferably equipped with cutting edges, while alternative edge forms can also be used. Adjacent to the forebody 2, the hull is preferably equipped on both sides with a waistline-like indentation 6, 6'. In other words, this indentation can essentially be described as a narrowing of the width of the hull as compared to the width of the hull at the first and second icebreaking means. The depth and length of the indentations 6, 6' can preferably be designed so that during the turning of the ship S, there is the smallest possible turning circle radius $\tau i$ and thus good maneuverability.

As shown in FIG. 2, the vessel S has an inner radius of turning designated as $\tau i$ and an outer radius of curvature designated as $\tau a$. The center of the turning circle is designated as M, and M' designates a line, generally perpendicular to the longitudinal axis 4 of the ship, which line M' intersects the apex of the turning circle in relation to the ship S. This line can also be called the zenithal line of the ship in relation to the turning circle.

Figure 3:
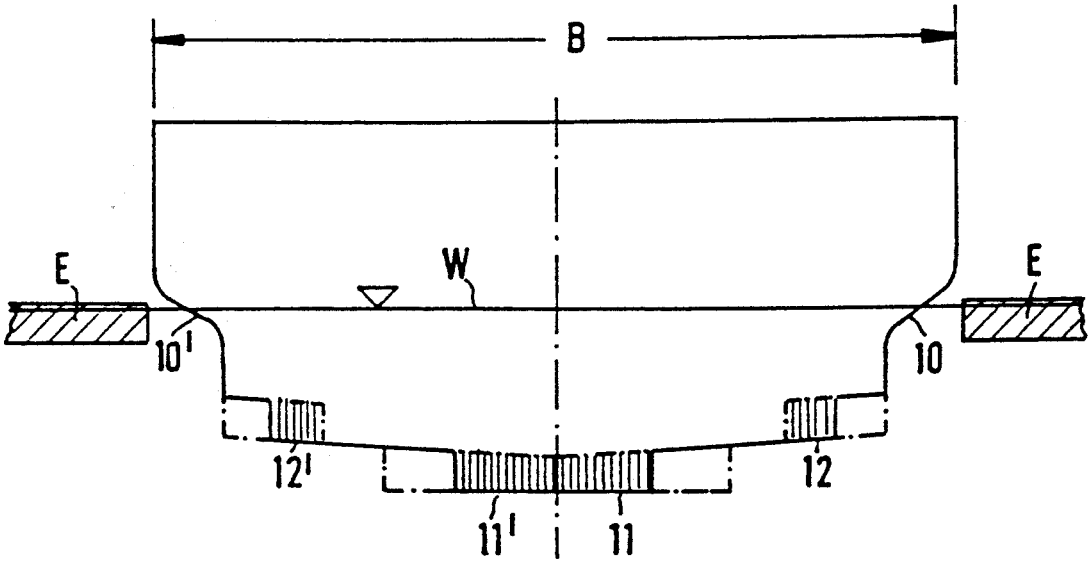
FIG. 3 shows a cross section of the hull taken along line III—III through the ship illustrated in FIG. 2.

In the embodiment illustrated in FIGS. 2 and 3, the portion 7 of the hull, adjacent and astern to the waistline-like indentations 6 and 6' runs essentially parallel to the longitudinal axis 4 of the ship.

On the stern intersection of the waistline-like indentation 6, 6' with the hull there are preferably second icebreaking means 9, 9', which are also preferably designed with cutting edges and are located in the vicinity of the water line W. These second icebreaking portions essentially lie at the zenithal line of the turning circle, and essentially define the longitudinal limit to the length of the indentations 6, 6'. These second icebreaking means 9, 9' preferably do not project beyond the width of the ship B. As shown in FIGS. 1 to 3, the portion 7 of the hull S adjacent to the indentation 6, 6' can also preferably be designed on its lateral flanks in the manner of a balcony 10, 10' as can be seen in particular in the cross sectional illustration shown in FIG. 3. The underside of this balcony section 10, 10' preferably runs diagonally upward away from the center of the ship towards the outside of the ship. These underside sections of the balconies 10, 10' preferably intersect the water line W in such a manner that the underside sections of the balconies act as suitable icebreaking planes during turning.

The underside of the hull is also preferably designed to force the broken ice out of the channel being cleared. In this regard, there is preferably a first set of sweeping or clearing projections 11, 11' located on the underside of the hull S. These first projections 11, 11' preferably split in a fork-like manner towards the stern. These projections can generally be labelled as "bottom projections". In addition, the underside of the hull is also preferably equipped with an additional, or second set of sweeping projections 12, 12'. This second set of projections, which may be termed "bilge projections", are preferably located adjacent to the waistline-like indentation 6, 6' and preferably become wider in a wedge shape in the stern direction. These bilge projections 12, 12' preferably lie in a higher plane than the plane of the bottom projections 11, 11', and act as additional accessories for clearing away, from the ice-free channel R, the ice chunks that get broken loose by the second icebreaking means 9, 9'. In effect, this clears the ice chunks from the vicinity of the propeller so as not to impede the propeller or possibly cause damage to the propeller.

According to the embodiment illustrated in FIG. 4, the water line W of the after-body can also be tapered toward the stern 8. The contour of the taper can preferably be selected so that the taper of the stern 8 approximately matches the geometry of the turning circle of the ship. This type of configuration for the stern would essentially allow the ship to make an easier turn, as very little additional ice would need to be broken by the underside sections of the stern balconies 10, 10' as this tapered stern section would essentially just follow along the already broken channel sides.

In summary, one feature of the invention resides broadly in an icebreaking ship, in which the forward quarter of the hull is equipped on both side flanks in the vicinity of the water line with first icebreaking means, and with second icebreaking means at some distance behind them, whereby the vicinity of the hull wall between the two icebreaking means is recessed such that the curve profile of the recess is approximately matched to the crown line, or zenithal line of the inside turning circle of the ship, characterized by the fact that the lateral limit of the second icebreaking means 9, 9' is designed so that it does not exceed the width B of the hull S and that the recessed hull wall area between the icebreaking means is designed as a waistline-like indentation 6, 6' in the hull S.

Another feature of the invention resides broadly in an icebreaking ship characterized by the fact that the second icebreaking means 9, 9' limits, or represents the limit of, the length of the waistline-like indentation in the vicinity of the crown line M' of the turning circle of the ship.

A yet further feature of the invention resides broadly in an icebreaking ship characterized by the fact that the second icebreaking means 9, 9' are also located in the vicinity of the water line W.

An additional feature of the invention resides broadly in an icebreaking ship characterized by the fact that the after-body is tapered toward the stern 8.

Another additional feature of the invention resides broadly in an icebreaking ship characterized by the fact that the side walls 7, 7' of the hull S, adjacent to the waistline-like indentation 6, 6' are designed continuously or in sections in the manner of a balcony 10, 10', and that the balcony 10, 10' has an icebreaker plane inclined at the water line W.

Another additional feature of the invention resides broadly in an icebreaking ship characterized by the fact that there are sweeper projections 11, 11', 12, 12' and that the sweeper projections 11, 11', 12, 12' correspond to both the first icebreaking means 5, 5' and to the second icebreaking means 9, 9', whereby the sweeper projections 11, 11' are lower than the sweeper projections 12, 12'.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A ship for breaking ice to clear a channel through an ice field in a direction of movement of the ship, the ship having a hull, the hull having a bow section, a stern section behind said bow section, and said hull comprising:

first means for breaking ice, said first icebreaking means being disposed at said bow section of said ship;

second means for breaking ice, said second icebreaking means being disposed substantially behind said first icebreaking means toward said stern section of said ship;

a recessed portion disposed between said first and said second icebreaking means;

a first side portion extending from said bow section to said stern section and a second side portion extending from said bow section to said stern section, said second side portion being spaced apart from said first side portion, said first and said second icebreaking means being disposed on both said first and said second side portions of said hull;

a first hull portion extending from said first icebreaking means to said second icebreaking means;

an upper portion disposed above said first and said second icebreaking means, and a lower portion comprising said first icebreaking means, said second icebreaking mean sand said recessed portion;

said upper portion of said hull having an essentially constant width along at least said first portion of said hull; and said essentially constant width of said upper portion of said first portion of said hull comprising a maximum width of said hull;

said hull having a first width at said second icebreaking means, said first width of said hull at said second icebreaking means being at most substantially equal to said maximum width of said hull; and said hull having a second width at said first icebreaking means, said second width of said hull at said first icebreaking means being at most substantially equal to said maximum width of said hull.

2. The ship according to claim 1, wherein:

said ship is for being disposed in water to a depth defined by a water line; and said first and said second icebreaking means are disposed at the water line of the ship.

3. The ship according to claim 2, wherein:

said ship defines a path during a turn;

said path defining at least a portion of a circle during said turn;

said at least a portion of a circle having a center point;

one of said first and said second side portions of said ship being disposed towards said center point during said turn, and the other of said first and said second side portions being disposed away from said center point during said turn;

said at least a portion of a circle having an inner radius of curvature from said center point to said one of said side portions disposed towards said center point and an outer radius of curvature from said center point to the other of said side portions disposed away from said center point; and said recessed portion being configured to provide a minimum inner radius of curvature.

4. The ship according to claim 3, wherein:

said recessed portion has a profile;

said profile of said recessed portion corresponds substantially to said inner radius of curvature; and said lower portion of said hull has a third width at said recessed portion, said third width being less than said first width of said second icebreaking means and said second width of said first icebreaking means to define a waistline-like indentation in the hull between said first and said second icebreaking means.

5. The ship according to claim 4, wherein:

said turning circle of said ship has an apex; and said second icebreaking means is disposed on said hull substantially at said apex of said turning circle to limit a length of said recessed portion along said hull.

6. The ship according to claim 5, wherein:

said ship has a first end at said bow section and a second end at said stern section;

said hull at said stern section has tapered side portions tapering towards said second end of said ship; and said tapered side portions are configured to substantially match said outer radius of curvature of said turning circle of said ship.

7. The ship according to claim 6, wherein:

said first and second side portions of said stern section of said hull have a first wall portion for being disposed below the water line, a second wall portion for being disposed above the water line, and a connecting portion connecting said first wall portion to said second wall portion;

said connecting portion being disposed substantially along said water line of said ship;

said hull having a fourth width at said first wall portion and a fifth width at said second wall portion, said fourth width at said first wall portion being less than said fifth width at said second wall portion; and said connecting portion being angled upwardly between said second wall portion and said first wall portion.

8. The ship according to claim 7, wherein:

said lower portion of said hull additionally comprises a base portion for being disposed at the bottom of said ship;

said base portion comprising at least a first and a second projection disposed along said base portion for forcing broken ice outwardly away from said hull;

said first projection corresponding substantially to said first icebreaking means and said second projection corresponding substantially to said second icebreaking means; and said first projection being disposed on a lower plane on said hull than said second projection.

9. The ship according to claim 8, wherein:

said first end of said ship is rounded from said first side portion to said second side portion;

said connecting portion between said first wall portion and said second wall portion comprises third means for breaking ice in a lateral direction of movement of said second end of said ship during said turn;

said first projection from said base portion of said hull increases in width in a direction from said first end of said ship towards said second end of said ship to force broken ice outwards towards said side portions of said ship; and said second projection from said base portion of said hull increases in width in a direction from said first end of said ship towards said second end of said ship to force broken ice outwards towards said side portions of said ship.

10. A hull for an icebreaking ship for breaking ice to clear a channel through an ice field in a direction of movement of the ship, the ship for being disposed in water to a depth defined by a water line, said hull having, a bow section, a stern section disposed behind said bow section, and said hull comprising:

first means for breaking ice, said first icebreaking means being disposed at said bow section of said ship and at the water line;

second means for breaking ice, said second icebreaking means being disposed substantially behind said first icebreaking means towards said stern section of said ship and at the water line of the ship;

a recessed portion disposed between said first and said second icebreaking means;

a first hull portion extending from said first icebreaking means to said second icebreaking means;

an upper portion disposed above said first and said second icebreaking means, and a lower portion comprising said first icebreaking means, said second icebreaking means and said recessed portion;

said upper portion of said hull having an essentially constant width along at least said first portion of said hull; and said essentially constant width of said upper portion of said first portion of said hull comprising a maximum width of said hull;

said hull having a first width at said first icebreaking means, a second width at said second icebreaking means, and a third width at said recessed portion; and said third width at said recessed portion being less than said first width and said second width to define a waistline-like indentation between said first and said second icebreaking means.

11. The hull of an icebreaking ship according to claim 10, wherein:

said hull has a first side portion and a second side portion spaced apart from said first side portion;

each of said first and said second side portions comprises a first icebreaking means, a second icebreaking means, and a recessed portion; and said first width at said first icebreaking means and said second width at said second icebreaking means are at most substantially equal to said maximum width of said hull.

12. The hull of an icebreaking ship according to claim 11, wherein:

said ship defines a path during a turn;

said path defining at least a portion of a circle during said turn;

said at least a portion of a circle having a center point;

one of said first and said second side portions of said ship being disposed towards said center point during said turn, and the other of said first and said second side portions being disposed away from said center point during said turn;

said at least a portion of a circle having an inner radius of curvature from said center point to said one of said side portions disposed towards said center point and an outer radius of curvature from said center point to the other of said side portions disposed away from said center point; and said recessed portion being configured to provide a minimum inner radius of curvature.

13. The hull of an icebreaking ship according to claim 12, wherein:

said recessed portion has a profile; and said profile of said recessed portion corresponds substantially to said inner radius of curvature.

14. The hull of an icebreaking ship according to claim 13, wherein:

said at least a portion of a circle of said turning path has a apex;

said second icebreaking means is disposed on said hull substantially at said apex of said at least a portion of a circle to limit a length of said recessed portion along said hull.

15. The hull of an icebreaking ship according to claim 14, wherein:

said ship has a first end at said bow section and a second end at said stern section;

said hull at said stern section has tapered side portions tapering towards said second end of said ship; and said tapered side portions are configured to substantially match said outer radius of curvature of said at least a portion of a circle of said turning path.

16. The hull of an icebreaking ship according to claim 15, wherein:

said first and said second side portions of said stern section of said hull have a first wall portion for being disposed below the water line, a second wall portion for being disposed above the water line, and a connecting portion connecting said first wall portion to said second wall portion;

said connecting portion being disposed substantially along said water line of said ship;

said hull having a fourth width at said first wall portion and a fifth width at said second wall portion, said fourth width at said first wall portion being less than said fifith width at said second wall portion; and said connecting portion being angled upwardly between said second wall portion and said first wall portion.

17. The hull of an icebreaking ship according to claim 16, wherein:

said lower portion of said hull has a base portion for being disposed at the bottom of said ship;

said base portion comprising at least a first and a second projection disposed along said base portion for forcing broken ice outwardly away from said hull;

said first projection corresponding substantially to said first icebreaking means and said second projection corresponding substantially to said second icebreaking means; and said first projection being disposed on a lower plane on said hull than said second projection.

18. The hull of an icebreaking ship according to claim 17, wherein:

said first end of said ship is rounded from said first side portion to said second side portion;

said connecting portion between said first wall portion and said second wall portion comprises third means for breaking ice in a lateral direction of movement of said second end of said ship during said turn;

said first projection from said base portion of said hull increases in width in a direction from said first end of said ship towards said second end of said ship to force broken ice outwards towards said side portions of said ship; and said second projection from said base portion of said hull increases in width in a direction from said first end of said ship towards said second end of said ship to force broken ice outwards towards said side portions of said ship.

* * * * *

UNITED STATES PATENT AND TRADEMARK OFFICE

CERTIFICATE OF CORRECTION

PATENT NO. : 5,231,944

DATED : August 3, 1993

INVENTOR(S) : Peter JANS, Karl-Heinz RUPP and Jens-Holger HELLMANN

It is certified that error appears in the above-indentified patent and that said Letters Patent is hereby corrected as shown below:

In column 6, line 58, Claim 1, after 'icebreaking', delete "mean sand" and insert --means and--.

In column 9, line 44, Claim 14, after 'has', delete "a" and insert --an--.

Signed and Sealed this

Twenty-sixth Day of April, 1994

Bruce Lehman

*Attest:*

BRUCE LEHMAN

*Attesting Officer*

*Commissioner of Patents and Trademarks*